US011365921B2

(12) United States Patent
De et al.

(10) Patent No.: US 11,365,921 B2
(45) Date of Patent: Jun. 21, 2022

(54) SYSTEM AND METHOD OF FREEZE PROTECTION FOR A CHILLER

(71) Applicant: Carrier Corporation, Palm Beach Gardens, FL (US)

(72) Inventors: Tathagata De, Charlotte, NC (US); Alberto Vecchiotti, Charlotte, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 536 days.

(21) Appl. No.: 15/760,964

(22) PCT Filed: Sep. 18, 2016

(86) PCT No.: PCT/US2016/052394

§ 371 (c)(1),
(2) Date: Mar. 16, 2018

(87) PCT Pub. No.: WO2017/049258

PCT Pub. Date: Mar. 23, 2017

(65) Prior Publication Data

US 2018/0274832 A1 Sep. 27, 2018

Related U.S. Application Data

(60) Provisional application No. 62/220,585, filed on Sep. 18, 2015.

(51) Int. Cl.
*F25B 47/00* (2006.01)
*F25B 49/02* (2006.01)
(Continued)

(52) U.S. Cl.
CPC ..... *F25B 47/006* (2013.01); *F25B 25/005* (2013.01); *F25B 49/005* (2013.01);
(Continued)

(58) Field of Classification Search
CPC ..... F25B 47/006; F25B 2700/21174; F25B 2700/21175; F25B 2700/21172; F25B 2700/21173
See application file for complete search history.

(56) References Cited

U.S. PATENT DOCUMENTS 3,443,394 A 5/1969 Kronick
4,151,725 A * 5/1979 Kountz ..... F04D 27/0246 62/182
(Continued)

FOREIGN PATENT DOCUMENTS

CN 102032731 A 4/2011
CN 102467135 A 5/2012
(Continued)

OTHER PUBLICATIONS

International Search Report and Written Opinion for application PCT/US2016/052394, dated Jan. 12, 2016, 10 pages.

*Primary Examiner* — Nelson J Nieves
(74) *Attorney, Agent, or Firm* — Cantor Colburn LLP

(57) ABSTRACT

A system and method of freeze protection for a chiller including a metering device in flow communication with a condenser, a controller in electrical communication with the metering device, wherein the controller is configured to determine whether the difference between the fluid characteristic of the first liquid and the fluid characteristic of the second liquid is greater than a freezing limit, and enter a freeze protection mode if the difference between the fluid characteristic of the first liquid and the fluid characteristic of the second liquid is greater than the freezing limit.

5 Claims, 2 Drawing Sheets

(51) Int. Cl.

| | |
|---|---|
| ***F25D 21/04*** | (2006.01) |
| ***F25B 25/00*** | (2006.01) |
| ***F25B 49/00*** | (2006.01) |
| ***F25D 21/02*** | (2006.01) |

(52) U.S. Cl.

CPC ..... *F25B 49/02* (2013.01); *F25D 21/02* (2013.01); *F25D 21/04* (2013.01); *F25B 2339/047* (2013.01); *F25B 2600/2513* (2013.01); *F25B 2700/1332* (2013.01); *F25B 2700/21173* (2013.01); *F25B 2700/21175* (2013.01)

(56) References Cited

U.S. PATENT DOCUMENTS

| | | | | |
|---|---|---|---|---|
| 4,864,829 | A * | 9/1989 | Manning | F25B 47/00 62/85 |
| 5,319,943 | A * | 6/1994 | Bahel | F24F 1/0003 62/156 |
| 5,435,145 | A | 7/1995 | Jaster | |
| 5,632,154 | A | 5/1997 | Sibik et al. | |
| 5,782,131 | A | 7/1998 | Lord et al. | |
| 5,809,794 | A | 9/1998 | Sibik et al. | |
| 5,809,795 | A | 9/1998 | Beaverson et al. | |
| 6,026,650 | A | 2/2000 | Beaverson et al. | |
| 6,035,651 | A | 3/2000 | Carey | |
| 6,050,098 | A | 4/2000 | Meyer | |
| 6,266,964 | B1 | 7/2001 | Meyer et al. | |
| 6,571,566 | B1 | 6/2003 | Temple et al. | |
| 6,619,061 | B2 | 9/2003 | Beaverson et al. | |
| 7,621,141 | B2 | 11/2009 | McCormick et al. | |
| 7,631,508 | B2 | 12/2009 | Braun et al. | |
| 8,046,107 | B2 | 10/2011 | Zugibe et al. | |
| 8,132,420 | B2 | 3/2012 | Okoren et al. | |
| 8,466,798 | B2 | 6/2013 | Gado et al. | |
| 8,769,973 | B2 | 7/2014 | Leaver et al. | |
| 2002/0036080 | A1 * | 3/2002 | Itoh | B60H 1/3207 165/202 |
| 2002/0174665 | A1 * | 11/2002 | Pritchard | B01D 53/265 62/93 |
| 2004/0020230 | A1 * | 2/2004 | Kuwabara | F25B 6/04 62/238.6 |
| 2004/0261435 | A1 * | 12/2004 | Chen | F25B 9/008 62/190 |
| 2005/0172648 | A1 * | 8/2005 | Concha | F25B 30/02 62/150 |
| 2006/0144059 | A1 * | 7/2006 | Kang | F25B 49/005 62/129 |
| 2006/0191286 | A1 * | 8/2006 | Park | F25B 13/00 62/434 |
| 2006/0201167 | A1 * | 9/2006 | Bellemo | B01D 53/265 62/93 |
| 2010/0205987 | A1 * | 8/2010 | Okazaki | F25B 9/008 62/190 |
| 2011/0036113 | A1 * | 2/2011 | Kopko | F25B 29/003 62/324.5 |
| 2012/0117989 | A1 | 5/2012 | Turney et al. | |
| 2012/0279237 | A1 * | 11/2012 | Ushijima | F24D 3/18 62/80 |
| 2014/0311172 | A1 * | 10/2014 | Iwasaki | F24F 1/06 62/151 |
| 2014/0345307 | A1 * | 11/2014 | Bagley | F25B 49/02 62/115 |
| 2015/0053150 | A1 * | 2/2015 | Hiwatari | F24D 3/08 122/13.01 |
| 2015/0107278 | A1 * | 4/2015 | Schmitz | F25B 47/006 62/79 |
| 2015/0377541 | A1 * | 12/2015 | Yoshikawa | F25B 1/10 62/140 |
| 2017/0130996 | A1 * | 5/2017 | Hatanaka | F24F 11/89 |
| 2017/0227263 | A1 * | 8/2017 | Kopko | F25B 25/005 |
| 2018/0209697 | A1 * | 7/2018 | Nishida | F25B 47/02 |
| 2018/0231287 | A1 * | 8/2018 | Tanaka | F25B 30/02 |

FOREIGN PATENT DOCUMENTS

| | | | |
|---|---|---|---|
| CN | 203298540 | U | 11/2013 |
| CN | 103727695 | A | 4/2014 |
| CN | 104729033 | A | 6/2015 |
| EP | 2088390 | A2 | 8/2009 |
| EP | 2530410 | A1 | 12/2012 |
| TW | 200742824 | A | 11/2007 |
| WO | 0042365 | A1 | 7/2000 |
| WO | 2005098331 | A1 | 10/2005 |
| WO | 2009023756 | A2 | 2/2009 |
| WO | 2009076623 | A1 | 6/2009 |
| WO | 2014038470 | A1 | 3/2014 |
| WO | 2014100654 | A1 | 6/2014 |

* cited by examiner

SYSTEM AND METHOD OF FREEZE PROTECTION FOR A CHILLER

CROSS-REFERENCE TO RELATED APPLICATIONS

The present application is a nonprovisional patent application, which claims priority to 62/220,585, filed Sep. 18, 2015, which is herein incorporated in its entirety.

TECHNICAL FIELD OF THE DISCLOSED EMBODIMENTS

The presently disclosed embodiments generally relate to heating, ventilation, and air conditioning (HVAC) systems, and more particularly, to a system and method of freeze protection for a chiller.

BACKGROUND OF THE DISCLOSED EMBODIMENTS

Generally, a vapor-compression chiller consists of four primary components of the vapor-compression refrigeration cycle. They include a compressor, evaporator, condenser and a metering device. Vapor-compression chillers typically utilize HCFC or CFC refrigerants to achieve a refrigeration effect. Compressors are the driving force in a vapor-compression chiller and act as a pump for the refrigerant. Compressed refrigerant gas is sent from the compressor to a condenser unit that rejects the heat energy from the refrigerant to a loop of cooling water or air outside of the system. The transfer of heat allows the refrigerant gas to condense into a liquid which is then sent to a metering device. The metering device restricts the flow of liquid refrigerant which causes a drop in pressure. The drop in pressure causes the warm refrigerant liquid to change phase from liquid to gas and, thereby, drop in temperature. The gaseous refrigerant then enters a heat exchanger whereby it absorbs heat from a second loop of water.

The metering device is typically positioned so that the expanding refrigerant gas is contained within the evaporator, transferring the heat energy from the water to be cooled into the refrigerant gas. The warm refrigerant gas is then sent back to the compressor to start the cycle over again and the newly chilled water in the separate loop can now be used for cooling.

When the compressor accelerates to pump the refrigerant and, thereby, begin operation or increase capacity, a drop in pressure is created within the evaporator. As a result, the temperature of the refrigerant in the evaporator drops, and in some instances, the temperature may drop below the freezing point of the liquid (e.g. water) being cooled. This could lead to damage of the system carrying the liquid. There is therefore a need for a system and method to control the temperature drop in the evaporator to prevent freezing of the liquid being cooled.

SUMMARY OF THE DISCLOSED EMBODIMENTS

In one aspect, a method of freeze protection for a chiller is provided. The method includes operating a first sensor to measure a fluid characteristic of the first liquid and operating a second sensor to measure a fluid characteristic of the second liquid, operating a controller to determine whether the difference between the fluid characteristic of the first liquid and the fluid characteristic of the second liquid is greater than a freezing limit, and operating the controller to enter a freeze protection mode if the difference between the fluid characteristic of the first liquid and the fluid characteristic of the second liquid is greater than the freezing limit.

In an embodiment, entering a freeze protection mode includes operating a third sensor to measure a volume of the first fluid within the condenser, and operating the metering device to decrease the volume of the first liquid within the evaporator to a minimum protection volume. In another embodiment, entering a freeze protection mode includes operating a third sensor to measure a volume of the first fluid within the condenser, and operating the metering device to increase the volume of the first liquid within the condenser to a maximum protection volume.

In one embodiment, the fluid characteristic of the first liquid is a temperature of the first liquid and the fluid characteristic of the second liquid is a temperature of the second liquid. In an embodiment, the freezing limit is approximately 4 degrees Fahrenheit.

In one aspect, a chiller is provided. The chiller includes a controller configured determine whether the difference between a fluid characteristic of a first liquid and a fluid characteristic of a second fluid is greater than a freezing limit, and enter a freeze protection mode if the difference between the fluid characteristic of the first liquid and the fluid characteristic of the second fluid is greater than the freezing limit. The chiller further includes a first sensor in electrical communication with the controller, wherein the first sensor is configured to measure the fluid characteristic of the first liquid, and a second sensor in electrical communication with the controller, wherein the second sensor is configured to measure the fluid characteristic of the second liquid.

In an embodiment, the chiller further includes a compressor configured to circulate a first fluid, a condenser in flow communication with the compressor, a metering device in flow communication with the condenser, an evaporator in flow communication with the metering device and the compressor, wherein the evaporator is configured to allow the first fluid and a second fluid to flow therethrough, and a third sensor in communication with the condenser, wherein the third sensor is configured to measure a volume of the first liquid. In an embodiment, the first sensor and the second sensor are in communication within the evaporator.

In an embodiment, the fluid characteristic of the first fluid is a temperature of the first fluid, and the fluid characteristic of the second fluid is temperature of the second fluid. In an embodiment, the freezing limit is approximately 4 degrees Fahrenheit.

In an embodiment, the controller is further configured to determine whether the volume of the first liquid in the condenser is equal to a minimum protection volume. In an embodiment, the controller is further configured to determine whether the volume of the first liquid in the evaporator is equal to a maximum protection volume.

DETAILED DESCRIPTION OF THE DISCLOSED EMBODIMENTS

Figure 1:
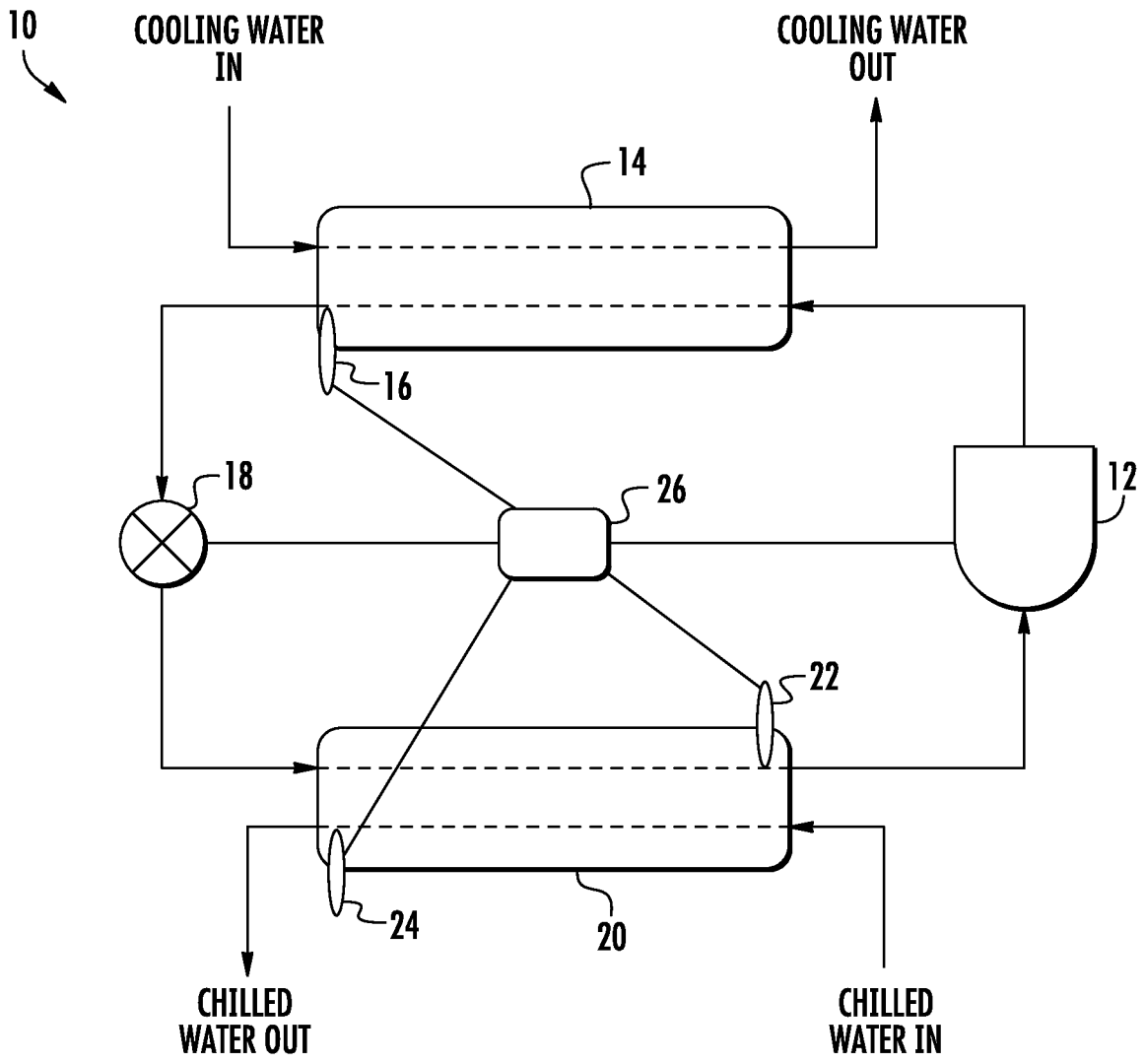
FIG. 1 illustrates a schematic diagram of a chiller according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 schematically illustrates an embodiment of a chiller, generally indicated at 10. The chiller 10 may be configured to condition air within an interior space. It will be appreciated that the chiller 10 may also be used for the controlled cooling of products to name one non-limiting example. The chiller 10 includes a compressor 12 in flow communication with a condenser 14. The chiller 10 further includes a third sensor 16 in communication with the condenser 14. The third sensor 16 is configured to measure a volume of a first liquid flowing through the condenser 14. In an embodiment, the first liquid is a refrigerant.

The condenser 14 is in fluid communication with a metering device 18, for example an expansion device to name one non-limiting example. In one embodiment, the expansion device may be an electronic expansion valve or any other type of known expansion device. The metering device 18 is in fluid communication with an evaporator 20, and the evaporator 20 is in fluid communication with the compressor 12 to complete the refrigeration circuit.

The chiller 10 further includes a first sensor 22 and a second sensor 24 in communication with the evaporator 20. The first sensor 22 is configured to measure a fluid characteristic of the first liquid as it flows through the evaporator 20. The second sensor 24 is configured to measure a fluid characteristic of a second liquid. In an embodiment, the second liquid is a conditioning liquid (e.g. water or brine to name a couple of non-limiting examples) as it flows through the evaporator 18. In one embodiment, the first sensor 22 and the second sensor 24 may be configured to measure a temperature of the first liquid and the second liquid. It will be appreciated that the first sensor 22 and the second sensor 24 may be configured to measure a pressure of the first liquid and the second liquid, from which a temperature of the first liquid and the second liquid may be determined. It will also be appreciated that the first sensor 22 and the second sensor 24 may be placed in any suitable location to measure the temperature and/or pressure of the first liquid and the second liquid as they flow through or exits the evaporator 20.

The chiller further includes a controller 26 in electrical communication with the compressor 12, metering device 18, and each of the sensors 16, 22, and 24 to control the operation and/or receive data from the components within the circuit. The controller 26 includes a processor and a memory (not shown), wherein the processor and memory are configured to operate the chiller 10 in accordance with the method 100 as later described herein.

Figure 2:
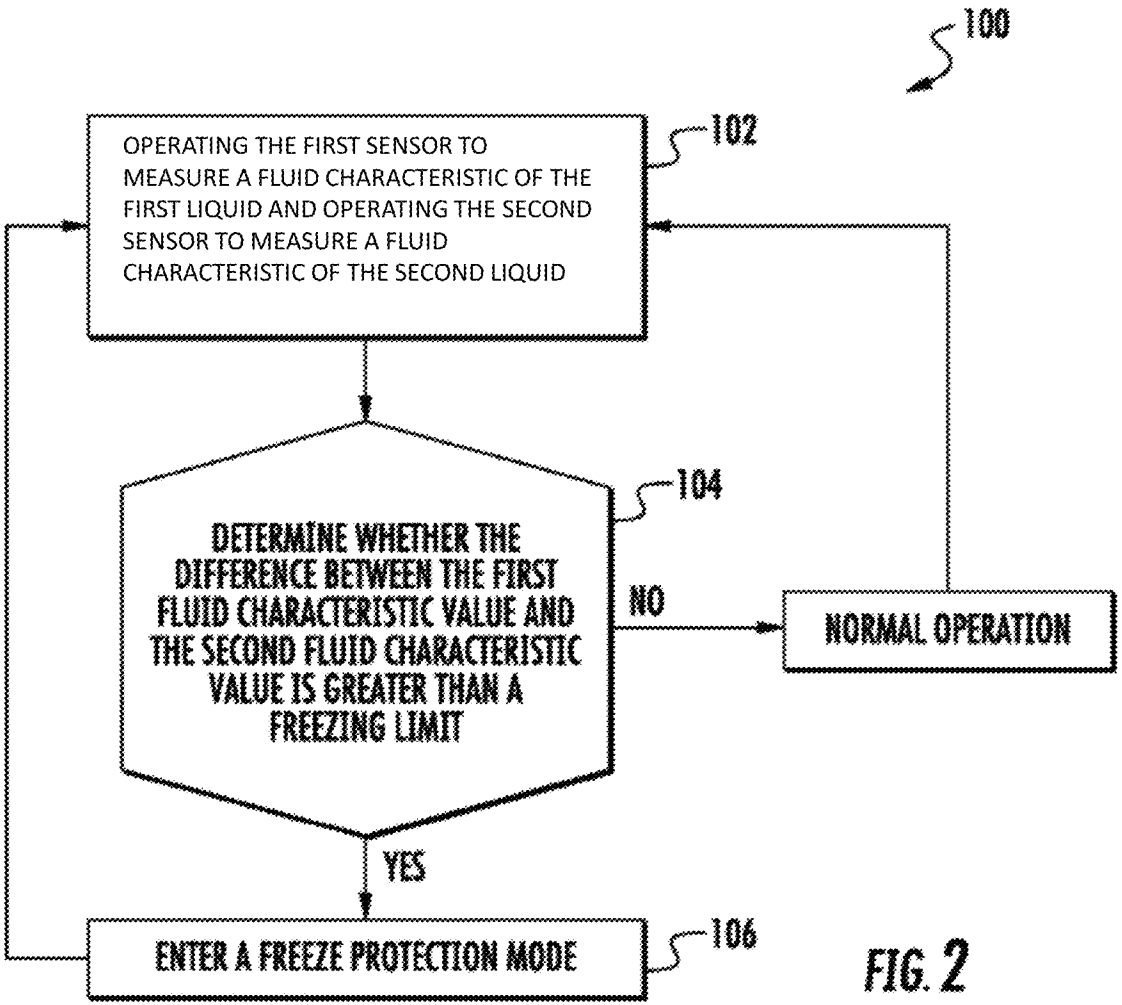
FIG. 2 illustrates a schematic flow diagram of a method of protecting an evaporator from freezing according to one embodiment of the present disclosure.

FIG. 2 illustrates a method of freeze protection for a chiller 10, the method generally indicated at 100. The method 100 includes step 102 of operating the first sensor 22 to measure a fluid characteristic of the first liquid and operating the second sensor 24 to measure a fluid characteristic of the second liquid. In an embodiment, the fluid characteristic of the first liquid is a temperature of the first fluid in the evaporator 20 or at the exit of the evaporator 20. In an embodiment, the fluid characteristic of the second liquid is a temperature of the second fluid in the evaporator 20 or at the exit of the evaporator 20. For example, as the refrigerant and the cooling liquid flow through the evaporator 20, the first sensor 22 measures the temperature of the refrigerant and the second sensor 24 measures the temperature of the cooling liquid.

The method 100 further includes step 104 of operating the controller 26 to determine whether the difference between the first fluid characteristic and the second fluid characteristic is greater than a freezing limit. In an embodiment, the freezing limit is approximately 4 degrees Fahrenheit (approximately 2.2 degrees Celsius). It will be appreciated that the freezing limit is adjustable, and may be greater than or less than approximately 4° F. For example, the controller 26 obtains the temperature of the refrigerant from the first sensor 22, and the temperature of the cooling liquid from the second sensor 24. The controller 26 determines the difference between the two temperature values and determines whether the difference is greater than 4° F.

Some refrigerants such as R134a for example, and the copper conduits within the chiller 10, have a typical evaporator approach temperature differential (the absolute value of the temperature measured by the first sensor 22 minus the temperature measured by the second sensor 24) of approximately 1-2° F. A temperature differential above 1-2° F. may indicate a low amount of refrigerant, and/or poor heat transfer that requires corrective action to be taken. It will be appreciated that the freezing limit may be dependent upon type of refrigerant, medium being cooled (e.g. water), material of the tubes (copper/aluminum), heat transfer coefficient of the tube, amount of refrigerant in the evaporator, flow rate of water inside tube, etc. to name a few non-limiting examples.

The method further includes step 106 of operating the controller 26 to enter a freeze protection mode if the difference between the fluid characteristic of the first liquid and the fluid characteristic of the second liquid is greater than the freezing limit. In an embodiment, operating the controller 26 to enter a freeze protection mode includes operating the third sensor 16 to measure a volume of the first liquid within the condenser 14, and transmitting a signal to operate the metering device 18 such that the volume of the first liquid is increased within the condenser 14 to a maximum protection volume. In another embodiment, operating the controller 26 to enter a freeze protection mode includes operating the third sensor 16 to measure a volume of the first liquid within the condenser 14, and transmitting a signal to operate the metering device 18 such that the volume of the first liquid is decreased within the condenser 14 to a minimum protection volume.

For example, if the temperature difference between the refrigerant and the cooling liquid is greater than 4° F., the controller 26 receives volume data from the third sensor 16, and transmits a signal to operate the metering device 18 to effectively increase the volume of refrigerant in the condenser 14 to a minimum protection volume. In another embodiment, the controller 26 may transmit a signal to operate the metering device 18 to decrease the volume of refrigerant in the condenser 14 to a maximum protection volume.

The increased volume of refrigerant in the evaporator 18 effectively reduces the amount of refrigerant within the condenser 14. It will be appreciated that the minimum protection volume corresponds to the minimum amount of refrigerant in the condenser 14 to still operate the chiller 10 properly and safely. It will further be appreciated that the maximum protection volume corresponds to the maximum amount of refrigerant within the evaporator 20 to still operate the chiller 10 properly and safely. As more refrigerant flows through the evaporator 20, heat transfer improves in the evaporator 20 and the refrigerant heats the evaporator 20 above the freezing point.

Once the difference between the first fluid characteristic and the second fluid characteristic is less than or equal to the freezing limit for a pre-determined amount of time, the chiller 10 returns to step 102. In one embodiment, the pre-determined amount of time is approximately 10 seconds. In one embodiment, the pre-determined amount of time may be greater than or less than 10 seconds.

Moreover, by controlling the amount of refrigerant entering and leaving the evaporator 20, it is less likely that compressor 12 will be flooded with refrigerant.

It will therefore be appreciated that the present embodiments includes a system and method of preventing freezing of an evaporator 20 in a chiller 10 by controlling the flow of a first liquid through the evaporator 20 as a result of a difference between a first fluid characteristic value and a second fluid characteristic value.

While the present disclosure has been illustrated and described in detail in the drawings and foregoing description, the same is to be considered as illustrative and not restrictive in character, it being understood that only certain embodiments have been shown and described and that all changes and modifications that come within the spirit of the present disclosure are desired to be protected.

What is claimed is:

1. A chiller comprising:

a controller, wherein the controller is configured to:

(a) determine whether a difference between a fluid characteristic of a first fluid and a fluid characteristic of a second fluid is greater than a freezing limit;

(b) enter a freeze protection mode if the difference between the fluid characteristic of the first fluid and the fluid characteristic of the second fluid is greater than the freezing limit;

a first sensor in electrical communication with the controller, wherein the first sensor is configured to measure the fluid characteristic of the first fluid;

a second sensor in electrical communication with the controller, wherein the second sensor is configured to measure the fluid characteristic of the second fluid;

wherein entering the freeze protection mode comprises:

(i) operating a third sensor to measure a volume of the first fluid within a condenser; and (ii) operating a metering device to increase the volume of the first fluid within the condenser to a first protection volume;

a compressor configured to circulate the first fluid;

the condenser in flow communication with the compressor;

the metering device in flow communication with the condenser;

an evaporator in flow communication with the metering device and the compressor, wherein the evaporator is configured to allow the first fluid and the second fluid to flow therethrough;

wherein the controller is further configured to determine whether a volume of the first fluid in the evaporator is equal to a second protection volume.

2. The chiller of claim 1, wherein the first sensor and the second sensor are in communication with the evaporator.

3. The chiller of claim 1, wherein the fluid characteristic of the first fluid is a temperature of the first fluid, and the fluid characteristic of the second fluid is a temperature of the second fluid.

4. The chiller of claim 1, wherein the freezing limit is approximately 4 degrees Fahrenheit.

5. The chiller of claim 1, wherein the controller is further configured to determine whether the volume of the first fluid in the condenser is equal to the first protection volume.

* * * * *